US007151499B2

(12) United States Patent
Avakian et al.

(10) Patent No.: US 7,151,499 B2
(45) Date of Patent: Dec. 19, 2006

(54) RECONFIGURABLE DIELECTRIC WAVEGUIDE ANTENNA

(76) Inventors: Aramais Avakian, 1658 Sinaloa Ave., Pasadena, CA (US) 91104; Alexander Brailovsky, 2 Whistling Isle, Irvine, CA (US) 92614; Mikhail Felman, 18319 Collins St., #8, Tarzana, CA (US) 91356; Irina Gordion, 2 Whistling Isle, Irvine, CA (US) 92614; Victor V. Khodos, 3140 Newton St., Apt. G409, Torrance, CA (US) 90505; Vladimir I. Litvinov, 236 Cinnamon Teal, Aliso Viejo, CA (US) 90656; Vladimir Manasson, 54 Coral Lake, Irvine, CA (US) 92614; Lev Sadovnik, 33 Trinity, Irvine, CA (US) 92612

( * ) Notice: Subject to any disclaimer, the term of this patent is extended or adjusted under 35 U.S.C. 154(b) by 84 days.

(21) Appl. No.: 11/116,792

(22) Filed: Apr. 28, 2005

(65) Prior Publication Data

US 2006/0244672 A1 Nov. 2, 2006

(51) Int. Cl.
*H01Q 13/00* (2006.01)

(52) U.S. Cl. ..... 343/785; 343/700 MS

(58) Field of Classification Search ..... 343/785, 343/700 MS, 772, 777, 776
See application file for complete search history.

(56) References Cited

U.S. PATENT DOCUMENTS 5,815,124 A 9/1998 Manasson et al. ..... 343/785
5,933,120 A * 8/1999 Manasson et al. ..... 343/788
5,959,589 A 9/1999 Sadovnik et al. ..... 343/765
5,982,334 A 11/1999 Manasson et al. ..... 343/785
6,211,836 B1 4/2001 Manasson et al. ..... 343/785
6,750,827 B1 6/2004 Manasson et al. ..... 343/785
7,088,301 B1 * 8/2006 Louzir et al. ..... 343/767

OTHER PUBLICATIONS

Manasson V A et al: "Monolithic electronically controlled millimeter-wave beam steering antenna" 1998 IEEE, pp. 215 and 217.

* cited by examiner

*Primary Examiner*—Hoanganh Le

(57) ABSTRACT

A reconfigurable directional antenna for transmission and reception of electromagnetic radiation includes a transmission line aligned with and adjacent to a metal antenna element with an evanescent coupling edge having a selectively variable electromagnetic coupling geometry. The shape and direction of the beam are determined by the selected coupling geometry of the coupling edge, as determined by the pattern of electrical connections selected for physical edge features of the coupling edge. The electrical connections between the edge features are selected by the selective actuation of an array of "on-off" switches that close and open electrical connections between individual edge features. The selection of the "on" or "off" state of the individual switches thus changes the electromagnetic geometry of the coupling edge, and, therefore the direction and shape of the transmitted or received beam. The actuation of the switches may be accomplished under the control of an appropriately-programmed computer.

30 Claims, 9 Drawing Sheets

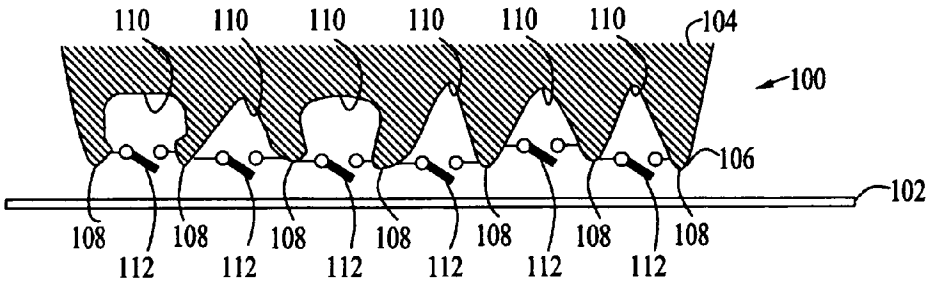
Fig. 1
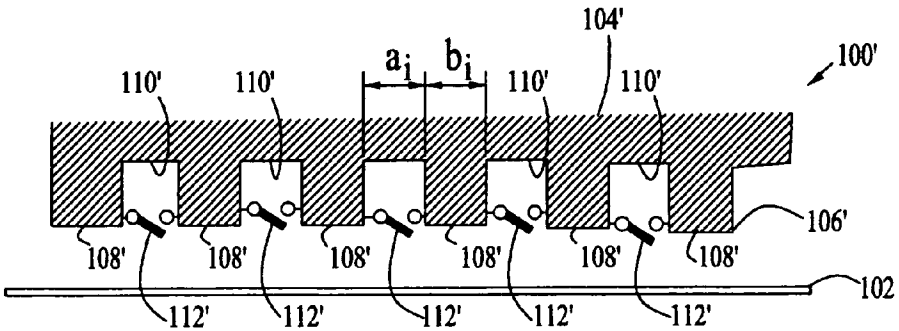
Fig. 2
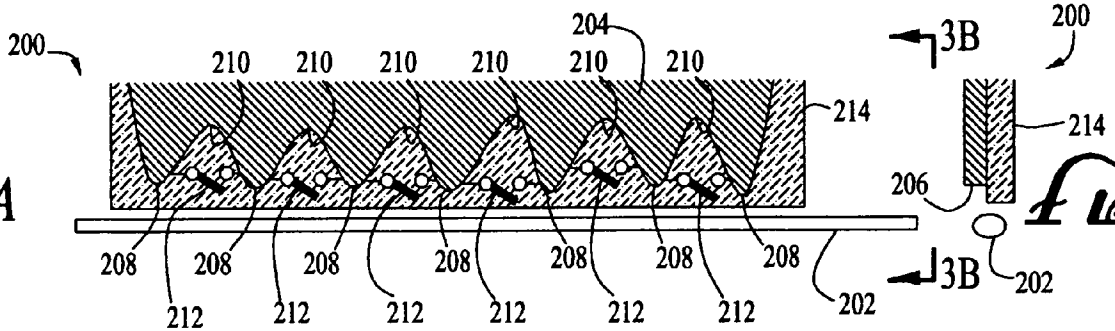
Fig. 3A
Fig. 3B

RECONFIGURABLE DIELECTRIC WAVEGUIDE ANTENNA

CROSS-REFERENCE TO RELATED APPLICATION

Not Applicable

FEDERALLY SPONSORED RESEARCH OR DEVELOPMENT

Not Applicable

BACKGROUND OF THE INVENTION

This invention relates generally to the field of dielectric waveguide antennas. More specifically, it relates to such antennas that transmit or receive electromagnetic radiation (particularly millimeter wavelength radiation) in selectable directions determined by controllably varying the effective electromagnetic coupling geometry of the antenna.

Dielectric waveguide antennas are well-known in the art, as exemplified by U.S. Pat. No. 6,750,827; U.S. Pat. No. 6,211,836; U.S. Pat. No. 5,815,124; and U.S. Pat. No. 5,959,589, the disclosures of which are incorporated herein by reference. Such antennas operate by the evanescent coupling of electromagnetic waves out of an elongate (typically rod-like) dielectric waveguide to a rotating cylinder or drum, and then radiating the coupled electromagnetic energy in directions determined by surface features of the drum. By defining rows of features, wherein the features of each row have a different period, and by rotating the drum around an axis that is parallel to that of the waveguide, the radiation can be directed in a plane over an angular range determined by the different periods. This type of antenna requires a motor and a transmission and control mechanism to rotate the drum in a controllable manner, thereby adding to the weight, size, cost and complexity of the antenna system.

Other approaches to the problem of directing electromagnetic radiation in selected directions include gimbal-mounted parabolic reflectors, which are relatively massive and slow, and phased array antennas, which are very expensive, as they require a plurality of individual antenna elements, each equipped with a costly phase shifter.

There has therefore been a need for a directional beam antenna that can provide effective and precise directional transmission as well as reception, and that is relatively simple to manufacture. Preferably, such an antenna would constitute a monolithic structure for the sake of simplicity and economy of manufacture.

SUMMARY OF THE INVENTION

Broadly, the present invention is a reconfigurable directional antenna, operable for both transmission and reception of electromagnetic radiation (particularly microwave and millimeter wavelength radiation), that comprises a metal antenna element (an antenna plate or layer) with an evanescent coupling edge having a selectively variable coupling geometry. The coupling edge is placed substantially parallel and closely adjacent to a transmission line, such as a dielectric waveguide. The term "selectively variable coupling geometry" is defined as an edge shape comprising a series or pattern of geometric physical edge features that can be selectively connected electrically to controllably change the effective electromagnetic coupling geometry of the antenna plate or layer. As a result of evanescent coupling between the transmission line and the antenna plate or layer when an electromagnetic signal is transmitted through the transmission line, electromagnetic radiation is transmitted or received by the antenna. The shape and direction of the transmitted or received beam are determined by the selected coupling geometry of the evanescent coupling edge, as determined, in turn, by the pattern of electrical connections that is selected for the edge features of the coupling edge.

In the preferred embodiments of the invention, the electrical connections between the plate edge features are selectively varied by the selective actuation of an array of "on-off" switches that close and open electrical connections between individual features of the coupling edge. The selection of the "on" or "off" state of the individual switches thus changes the electromagnetic geometry of the coupling edge of the antenna element, and, therefore the direction and shape of the transmitted or received beam. The configuration and pattern of the particular edge features are determined by computer modeling, depending on the antenna application, and will be a function of such parameters as the operating frequency (wavelength) of the beam radiation, the required beam pattern and direction, transmission (or reception) efficiency, and operating power. The actuation of the switches may be accomplished under the control of an appropriately-programmed computer, in accordance with an algorithm that may be readily derived for any particular application by a programmer of ordinary skill in the art.

As will be more readily appreciated from the detailed description that follows, the present invention provides an antenna that can transmit and/or receive electromagnetic radiation in a beam having a shape and direction that can be selected and varied. These operating characteristics are achieved in a monolithic structure that is compact, economical to manufacture, and reliable in operation.

BREIF DESCRIPTION OF THE DRAWINGS

FIG. 1 is a semi-diagrammatic plan view of a reconfigurable antenna in accordance with a first preferred embodiment of the invention;

FIG. 2 is a plan view, similar to that of FIG. 1, of a specific variant of the first preferred embodiment of the invention;

FIG. 3A is a plan view, similar to that of FIG. 1, of a second preferred embodiment of the invention;

FIG. 3B is an elevational view taken along line 3B—3B of FIG. 3A;

Figure 10A:
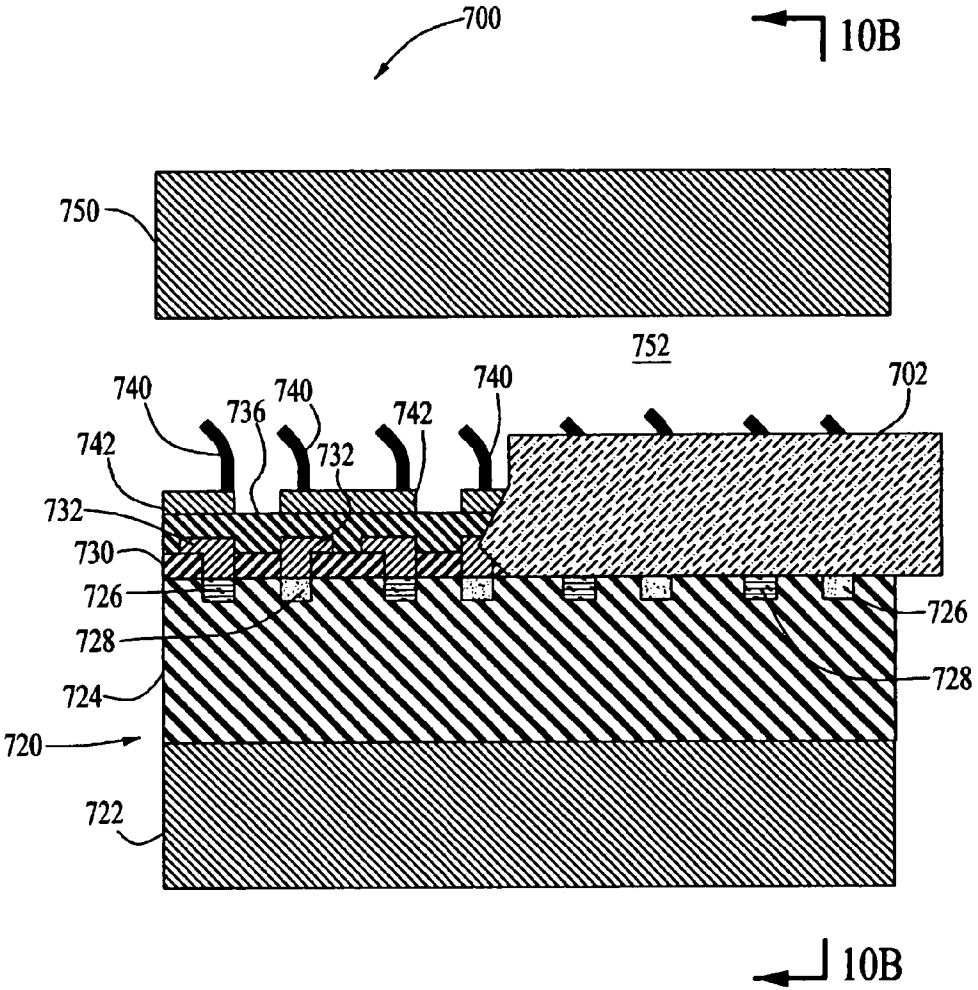
FIG. 10A is semi-diagrammatic longitudinal cross-sectional view of a seventh preferred embodiment of the invention.
Figure 10B:
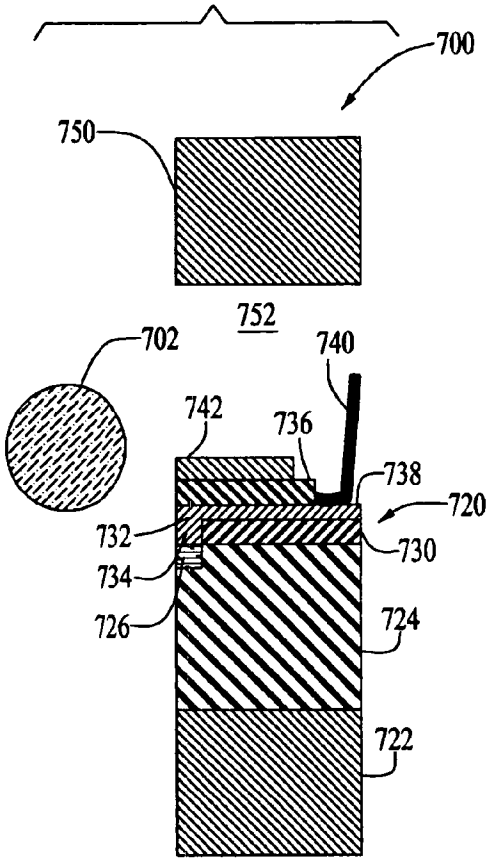
FIG. 10B is a transverse cross-sectional view taken along line 10B—10B of FIG. 10A.
Figure 11A:
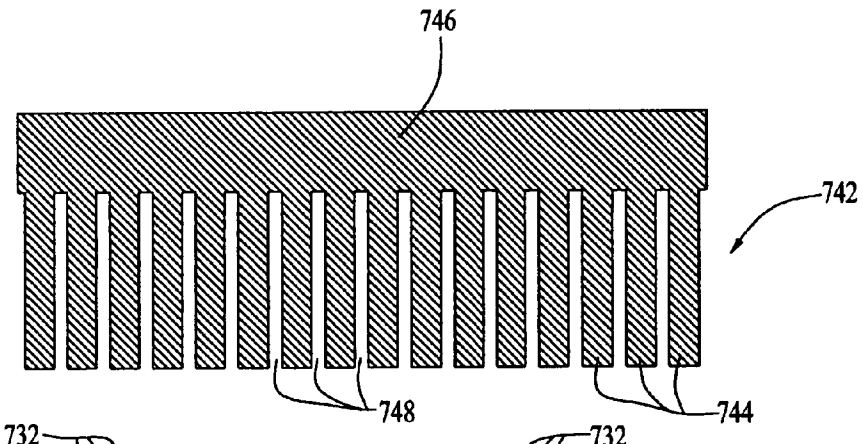
Figure 11B:
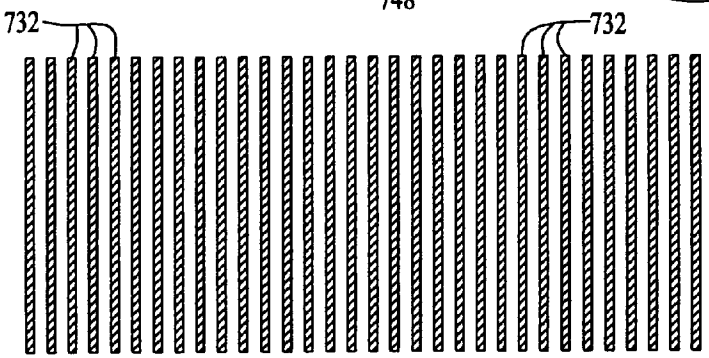
Figure 11C:
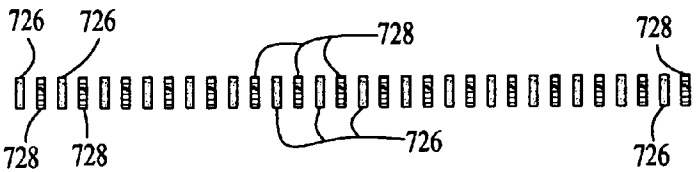
Figure 12A:
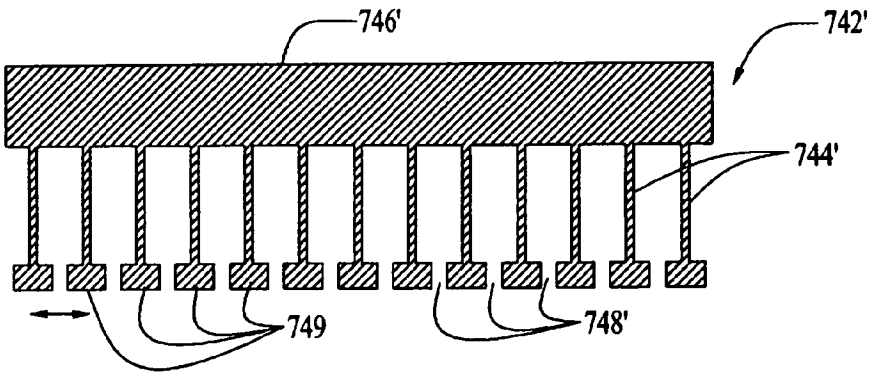
Figure 12B:
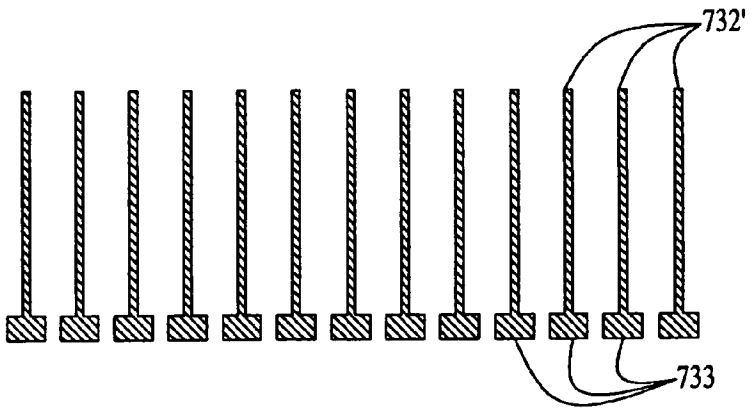
Figure 12C:
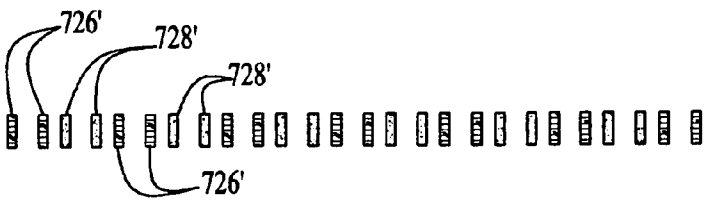
Figure 13:
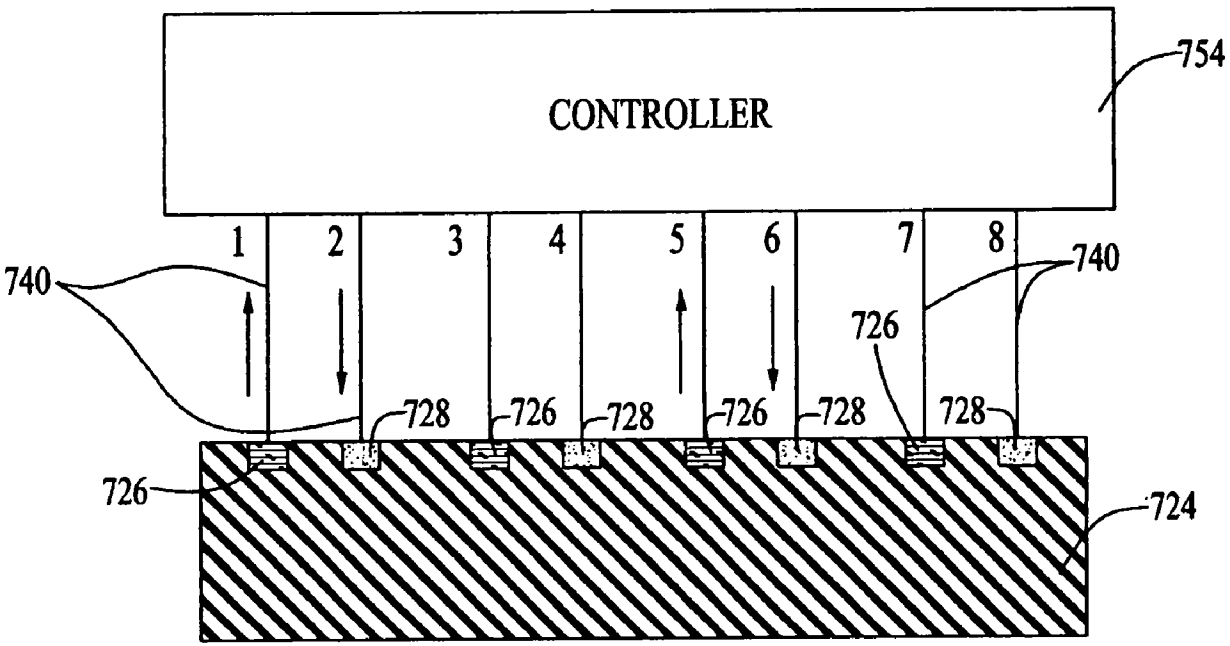

FIGS. 11A, 11B, and 11C are semi-diagrammatic views of the metal layers and electrodes of the embodiment of FIGS. 10A and 10B;

FIGS. 12A, 12B, and 12C are semi-diagrammatic views, similar to those of FIGS. 11A, 11B, and 11C, respectively, of the metal layers and electrodes of a variant of the embodiment of FIGS. 10A and 10B; and FIG. 13 is a semi-schematic view of the switch control system employed in the embodiment of FIGS. 10A and 10B.

DETAILED DESCRIPTION OF THE INVENTION

Referring first to FIG. 1, a reconfigurable antenna 100, in accordance with a first preferred embodiment of the invention, is shown. The antenna 100 comprises a transmission line 102, in the form of a narrow, elongate rod, and a metal antenna plate 104, having an evanescent coupling edge 106 that is aligned generally parallel to the axis of the transmission line 102. The alignment of the plate 104 and the transmission line 102, and their proximity to each other, allow the radiation from the transmission line 102 to be evanescently coupled to the antenna plate 104, as is well-known in the art.

While the transmission line 102 is preferably an elongate, rod-shaped dielectric waveguide, other types of transmission lines may be employed. Examples of such other types of transmission lines include slot lines, coplanar lines, rib waveguides, groove waveguides, imaging waveguides, and planar waveguides.

The coupling edge 106 of the antenna plate 104 is formed with a series or pattern of geometric figures. As shown in FIG. 1, the geometric figures may be a pattern of serrations or convexities 108 separated by complementary concavities or notches 110. Each adjacent pair of serrations or convexities 108 is selectively connectable by a switch 112. The switches 112 can be selectively closed to change the electromagnetic coupling geometry of the coupling edge 106 by controllably connecting selected pairs of convexities or serrations 108. By this mechanism of selectively connecting adjacent pairs of convexities 108, the coupling edge 106 may be defined as having a selectively variable coupling geometry.

The switches 112 may be any kind of micro-miniature switch, known in the art, that can be connected to the edge 106 of the coupling plate 104. For example, the switches 112 can be semiconductor switches (e.g., PIN diodes, bipolar transistors, MOSFETs, or heterojunction bipolar transistors), MEMS, piezoelectric switches, capacitive switches (such as varactors), lumped IC switches, ferro-electric switches, photoconductive switches, electromagnetic switches, gas plasma switches, and semiconductor plasma switches. The selective actuation of the switches 112 is advantageously controlled by an appropriately-programmed computer (for example, a microcomputer), in accordance with an algorithm that may be readily derived for any particular application by a programmer of ordinary skill in the art.

FIG. 2 shows an antenna 100' in accordance with a specific variant of the embodiment of FIG. 1, comprising a metal antenna plate 104' having an edge 106' configured as a square wave. Thus, the edge 106' comprises a series of square-shaped serrations or convexities 108' formed by a series of square-cut notches or concavities 110'. Each adjacent pair of convexities 108' is connectable by a switch 112'. In this variant, the width of any particular notch or concavity is $a_i$, and the width of the adjacent serration or convexity is $b_i$. The variant may be configured so that the concavities and the convexities are of equal widths ($a_i=b_i$), or of unequal widths ($a_i \neq b_i$). Alternatively, the concavities may all be of a first width a, and the convexities may all be of a second width b that is not equal to a. Another possible configuration is one in which the sum of the width of any concavity and the width of the next adjacent convexity is the same for each such paired concavity and convexity ($a_i+b_i=a_j+b_j$). Alternatively, the sum of the width of any concavity and the width of the next adjacent convexity is different for some or all of such concavity/convexity pairs. For some applications, it may be advantageous for the widths of each concavity and/or convexity to be less than one-half the wavelength of the emitted or received radiation.

FIGS. 3A and 3B illustrate an antenna 200, in accordance with a second embodiment of the invention, having a transmission line 202, as described above, and a metal antenna plate 204, the latter having an evanescent coupling edge 206 comprising a series of alternating convexities or serrations 208 and concavities or notches 210. As in the previously-described embodiment, each adjacent pair of convexities 208 is selectively connectable by a switch 212.

In the antenna of FIGS. 3A and 3B, the metal antenna plate 204 is advantageously formed or placed on a substrate 214. The substrate 214 may be a dielectric material, such as quartz, sapphire, ceramic, a suitable plastic, or a polymeric composite. Alternatively, the substrate 214 may be a semiconductor, such as silicon, gallium arsenide, gallium phosphide, germanium, gallium nitride, indium phosphide, gallium aluminum arsenide, or SOI (silicon-on-insulator).

Figures 4A, 4B, 5A, 5B, 6A, 6B:
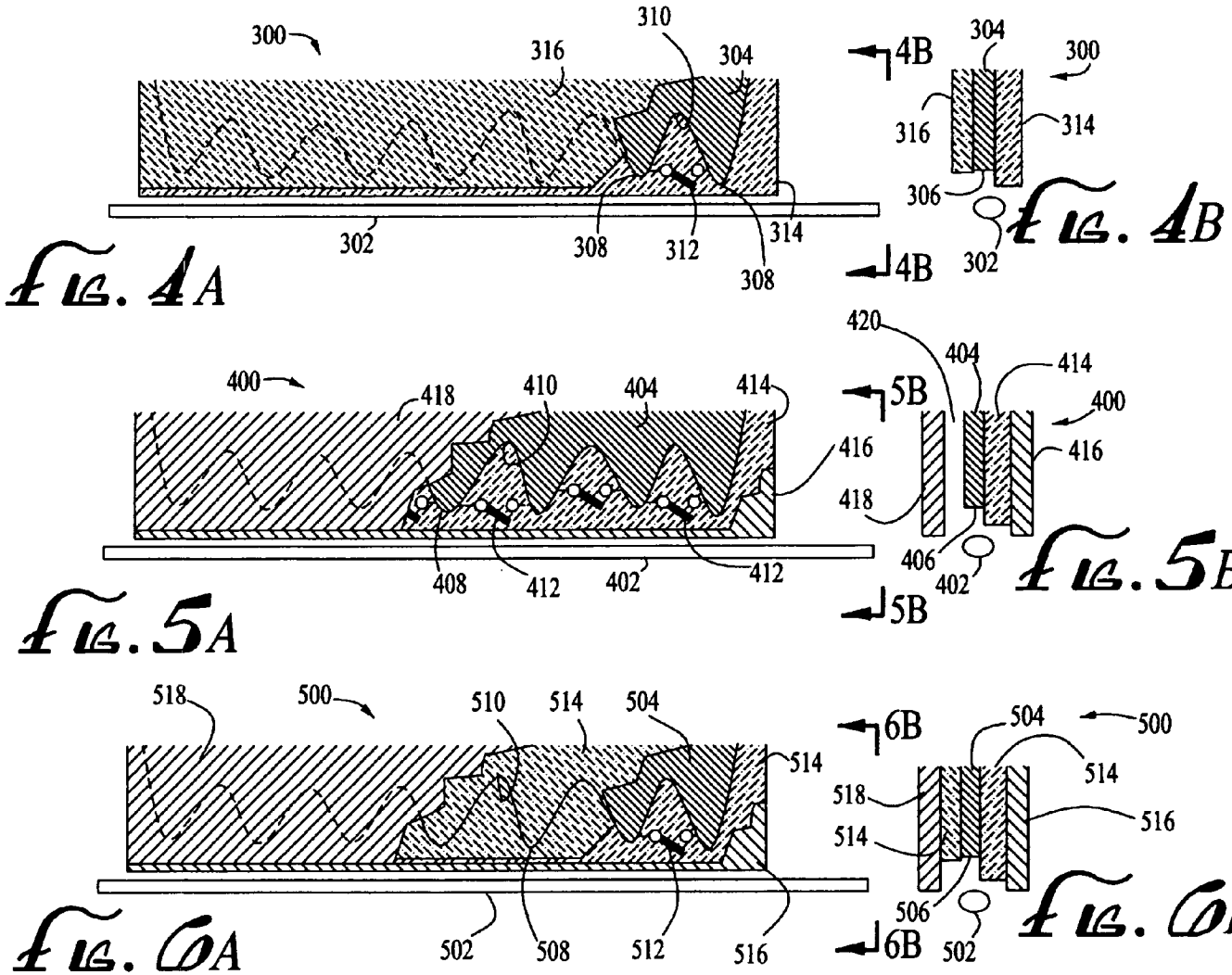
FIG. 4A is a plan view, similar to that of FIG. 1, of a third preferred embodiment of the invention.
FIG. 4B is an elevational view taken along line 4B—4B of FIG. 4A.
FIG. 5A is a plan view, similar to that of FIG. 1, of a fourth preferred embodiment of the invention.
FIG. 5B is an elevational view taken along line 5B—5B of FIG. 5A.
FIG. 6A is a plan view, similar to that of FIG. 1, of a fifth preferred embodiment of the invention.
FIG. 6B is an elevational view taken along line 6B—6B of FIG. 6A.

FIGS. 4A and 4B show an antenna 300 according to a third embodiment of the invention, which, like the previously-described embodiments, includes a transmission line 302 and a metal antenna plate 304. The antenna plate 304 has an evanescent coupling edge 306, having convexities 308 separated by concavities 310. Each adjacent pair of convexities 308 is selectively connectable by a switch 312, as discussed above. In this embodiment, the metal antenna plate 304 is sandwiched between a substrate 314 and a cover layer 316. As in the embodiment of FIGS. 3A and 3B, the substrate 314 may be either a dielectric or a semiconductor material. The cover layer 316 is also of a dielectric or semiconductor material, but not necessarily the same material as that of the substrate 314.

An antenna 400 in accordance with a fourth embodiment of the invention is shown in FIGS. 5A and 5B. The antenna 400 includes a transmission line 402 and a metal antenna plate 404. The antenna plate 404 has an evanescent coupling edge 406, having convexities 408 separated by concavities 410. Each adjacent pair of convexities 408 is selectively connectable by a switch 412, as discussed above. In this embodiment, the metal antenna plate 404 is formed on or adhered to the front surface of a dielectric or semiconductor substrate 414, the rear surface of which is attached to a metal backing plate 416. A metal face plate 418 is separated by an air gap 420 from the metal coupling plate 404.

FIGS. 6A and 6B illustrate an antenna 500 in accordance with a fifth embodiment of the invention. The antenna 500 includes a transmission line 502 and a metal antenna plate 504. The antenna plate 504 has an evanescent coupling edge 506, having convexities 508 separated by concavities 510. Each adjacent pair of convexities 508 is selectively connectable by a switch 512, as discussed above. In this embodiment, the antenna plate 504 is sandwiched between a pair of weakly conductive (semiconductor) or non-conductive (dielectric) plates or layers 514, and this sandwich structure is then further sandwiched between a metal backing plate 516 and a metal face plate 518.

Figure 7A:
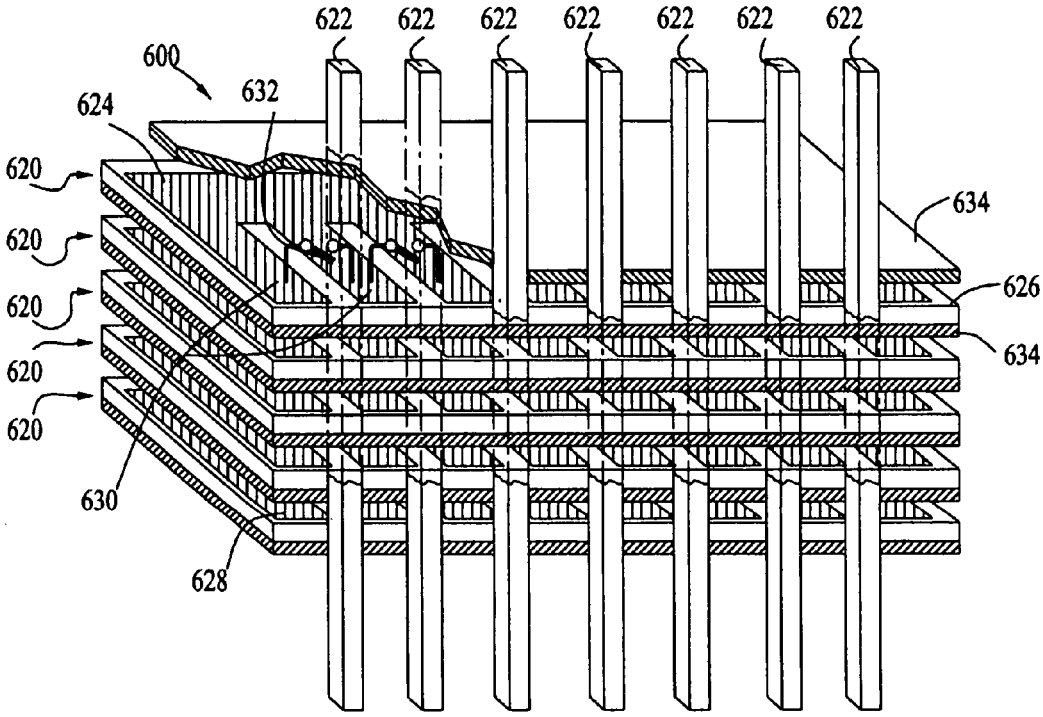
FIG. 7A is a semi-diagrammatic perspective view of a sixth preferred embodiment of the invention.

FIGS. 7A through 9B illustrate further embodiments of an antenna in accordance with the present invention, in which the electromagnetic beam direction can be varied in two dimensions. FIGS. 7A and 7B illustrate an antenna 600 in accordance with a sixth preferred embodiment of the invention. The antenna 600 is a composite antenna comprising a stacked array of substantially planar antenna elements 620, defining substantially parallel planes, and a transmission line element comprising an array of substantially parallel linear transmission lines 622 that are orthogonal to the planes of the antenna elements 620. Each of the antenna elements 620 may be formed in accordance with the embodiment of FIGS. 3A and 3B, the embodiment of FIGS. 4A and 4B, the embodiment of FIGS. 5A and 5B, or the embodiment of FIGS. 6A and 6B, as described above. As illustrated, the antenna elements 620 are formed in accordance with the embodiment of FIGS. 3A and 3B, so that each antenna element 620 comprises a metal antenna plate 624 attached to a substrate 626, which may be made of any of the above-mentioned dielectric or semi-conductive materials. Each of the antenna plates 624 includes a coupling edge 628 formed with a pattern of convexities 630, each adjacent pair of which is selectively connected by a switch 632. The antenna elements 620 are arranged so that their respective coupling edges 628 are in alignment. Evanescent coupling occurs between the transmission line element and the coupling edge 628 of each antenna element 620. It may be advantageous to separate each of the antenna elements 620 by a separation plate 634, which may be made of any suitable metal, such as, for example, aluminum, copper, or gold.

Figure 7B:
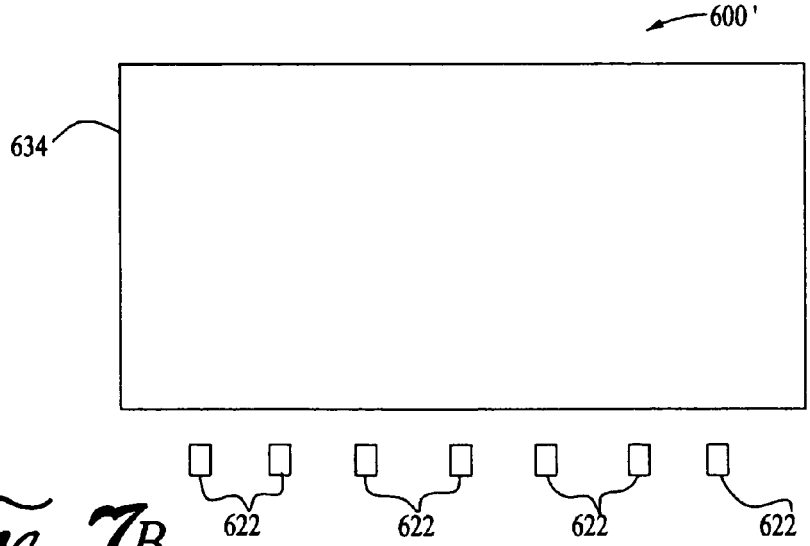
FIG. 7B is a top plan view of the embodiment of FIG. 7A.
Figure 8A:
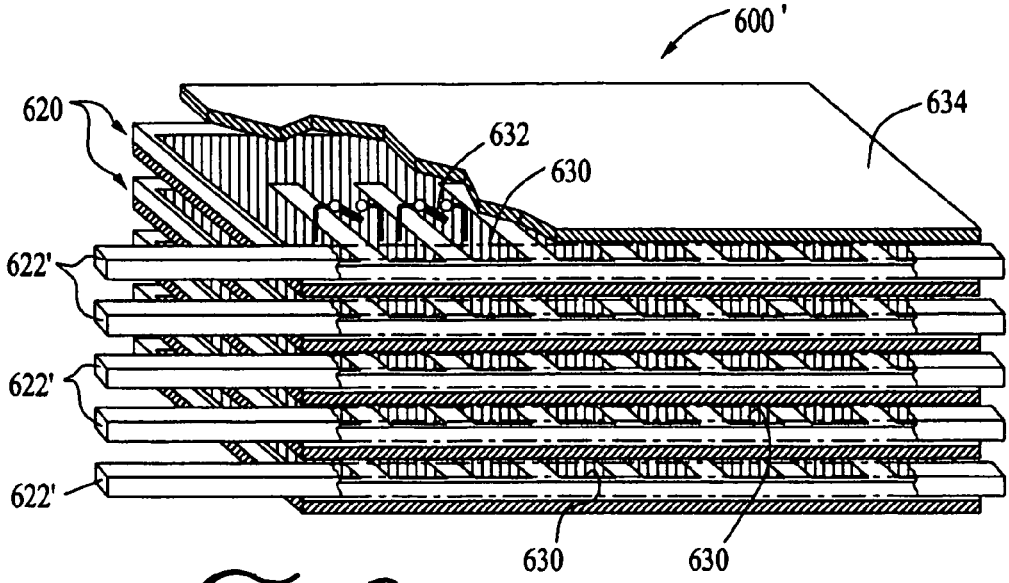
FIG. 8A is a semi-diagrammatic perspective view, similar to that of FIG. 7A, of a variant of the sixth preferred embodiment of the invention.
Figure 8B:
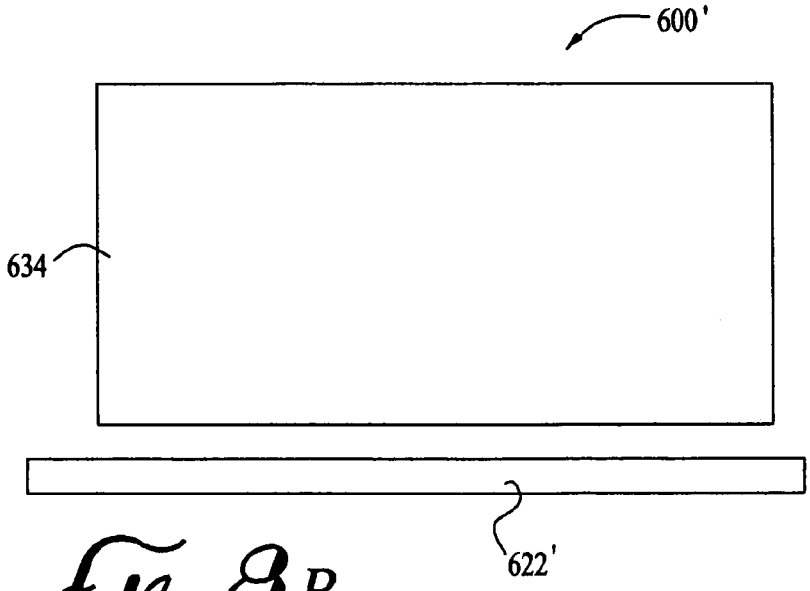
FIG. 8B is a top plan view of the embodiment of FIG. 8A.
Figure 9A:
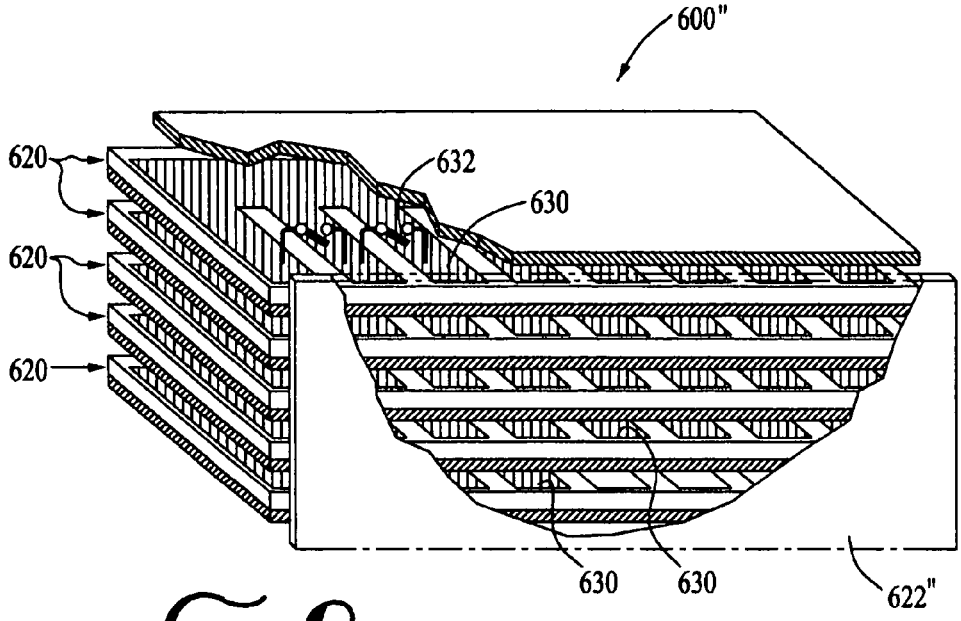
FIG. 9A is a semi-diagrammatic perspective view of another variant of the sixth preferred embodiment of the invention.
Figure 9B:
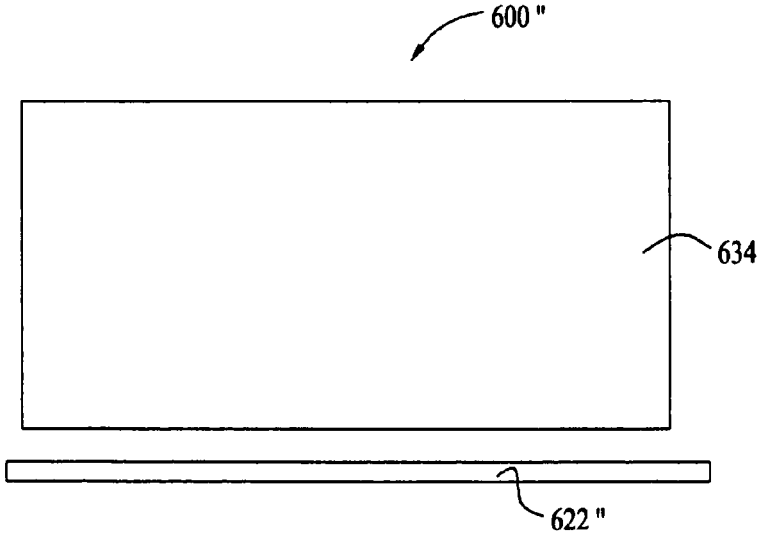
FIG. 9B is a top plan view of the embodiment of FIG. 9A.

FIGS. 8A and 8B illustrate a composite antenna 600' in accordance with a variant of the embodiment of FIGS. 7A and 7B, described above. The composite antenna 600' is substantially identical to the composite antenna 600 of FIGS. 7A and 7B, except that it includes a transmission line element comprising an array of substantially parallel linear transmission lines 622' that are substantially parallel to the planes of the antenna elements 620. FIGS. 9A and 9B illustrate a composite antenna 600" in accordance with another variant of the embodiment of FIGS. 7A and 7B. This variant employs a transmission line element comprising a planar transmission line 622" that is substantially orthogonal to the planes of the antenna elements 620.

FIGS. 10A through 11C illustrate an antenna 700 in accordance with a specific seventh embodiment of the invention, comprising a dielectric transmission line 702 that is spaced from and aligned with a multilayer coupling structure 720, in which a plurality of solid state switches are integrated. Specifically, the coupling structure 720 comprises a metal base layer 722 on which is disposed a semiconductor layer 724. In a specific example of the invention in accordance with this embodiment, the base layer 722 is a layer of aluminum of 5 mm thickness, and the semiconductor layer 724 is silicon, 0.5 mm thick, with a resistivity of 1 kilohm-cm. The upper surface of the semiconductor layer 724 is doped to provide an array of alternating P-doped switch electrodes 726 and N-doped switch electrodes 728 (as also shown in FIG. 11C). A first dielectric insulation layer 730, preferably of silicon dioxide, is formed on the top surface of the semiconductor layer 724. The first insulation layer 730 is masked and photo-etched, by conventional methods, to form an array of apertures that expose the electrodes 726, 728. In the specific example of the invention, the first insulation layer 730 is 0.5 micron in thickness.

An array of conductive metal contacts 732 (FIG. 11B) is provided on top of the first insulation layer 730. In the specific example referred to above, the metal contacts 732 are formed as a series of parallel strips of gold, of 0.5 micron in thickness. The contacts 732 may be formed by any suitable method, such as screen printing or electro-deposition. Each of the contacts 732 has a first end 734 that extends downward through an aperture in the first insulation layer 730 to establish electrical contact with one of the electrodes 726, 728. A second dielectric insulation layer 736 is formed on top of the first insulation layer 730, so as to cover the entirety of each of the contacts 732, except for a second end portion 738 of each of the contacts 732 that is left exposed, as shown in FIG. 10B. The second insulation layer 736, like the first insulation layer 730, is preferably formed of silicon dioxide, with a thickness of 0.5 micron. A switch signal wire 740 is attached, by conventional means, to each of the contacts 732 at the second end portion thereof. The purpose of the switch signal wires 740 is discussed below.

A metal antenna layer 742 is advantageously formed on top of the second insulation layer 736. As best shown in FIG. 11A, the antenna layer 742 comprises a plurality of parallel fingers 744 joined at one end to a continuous strip 746, and separated by slots or gaps 748. The metal antenna layer 742 corresponds to the antenna plate in the previously-described embodiments, with an evanescent coupling edge provided by the fingers 744 and the slots 748, and with the fingers 744 defining the convexities, and the slots 748 defining the concavities, as discussed above with the previously-described embodiments. Each of the fingers 744 overlies two adjacent contacts 732, as best shown in FIG. 10A. The fingers 744 and the slots 748 define a square wave coupling edge with a period, in the specific example discussed above, of 0.7 mm. In the specific example discussed above, the antenna layer 742 is made of gold, with a thickness of 1.0 micron.

The antenna 700 may advantageously include a metal cover layer 750 that is separated from the antenna layer 742 by an air gap 752. In the specific exampled referred to above, the cover layer 750 comprises a sheet of aluminum, of 5 mm thickness, and the air gap 752 is 3 mm across.

Referring to FIG. 13, a control mechanism is shown for selectively actuating the switches formed by adjacent pairs of the P and N electrodes 726, 728. As mentioned above, each of the contacts 732 is in contact with one of the electrodes 726, 728, and each of the contacts 732, in turn, is contacted by one of the wires 740. The wires 740 are connected to an electronic controller 754 that selectively provides individual energizing currents to each P-N pair of the electrodes 726, 728. The energizing currents cause carrier injection into the area in the semiconductor layer 724 between the electrodes in the selected electrode pair or pairs, thereby creating a conductive link between each energized electrode pair, each conductive link, in turn, being capacitively coupled to the overlying fingers 744. Those links correspond to the closed switches described above in connection with the previously-described embodiments, whereby two adjacent convexities (fingers 744) of the coupling edge are electrically connected. The electrode pairs that are not energized remain disconnected, corresponding to open switches. In the example shown in FIG. 13, electrodes 1 and 2 are energized by the controller 754, thereby "closing" the semiconductor switch between them. Likewise, a semiconductor switch is closed between electrodes 5 and 6, which are also energized by the controller 754. By closing the semiconductor switches between the P and N electrodes in selected electrode pairs, the configuration of the coupling edge provided by the antenna layer 742 is altered by the above-mentioned capacitively-coupled links.

In operation, the transmission line 702 supports an electromagnetic wave propagating along the transmission line 702. Part of the wave propagates outside of the physical confines of the transmission line 702, forming an evanescent wave. The evanescent wave interacts with the coupling edge defined by the antenna layer 742, as discussed above, and is scattered by the coupling edge. This scattered wave is no longer supported by the transmission line 702; rather, it propagates in free space. The wave front of the scattered wave depends on the selected configuration of the coupling edge of the antenna layer 742, which can be selectively varied by the controller 754, in the manner described above.

In the example described above in connection with FIGS. 10A through 11C, the normative (all switches "off") configuration of the antenna layer 742 is a periodic structure with a period of 0.7 mm. Numerical simulation indicates that to form a quasi-parallel beam propagating in a direction forming an angle of 80 degrees with the transmission line 702, every fifth pair of electrodes 726, 728 must be energized. If every fourth pair of electrodes 726, 728 is energized, the propagated beam will be in a direction forming an angle of 92.5 degrees with the transmission line.

A second specific example of an antenna in accordance with the embodiment of FIGS. 10A and 10B includes essentially the same structure as the first specific example described above, except for the configurations of the contacts, the antenna layer, and the P and N electrodes, which are shown in FIGS. 12A, 12B, and 12C. Specifically, in this second example, a plurality of P-electrode pairs 726' alternate with a plurality of N-electrode pairs 728', so that there are two P-electrodes 726' followed by two N-electrodes 728', etc., as shown in FIG. 12C. A plurality of substantially parallel linear contacts 732' (FIG. 12B) is provided on the surface of the first insulation layer 730, each terminating in a transverse contact head 733 that extends downward into the semiconductor layer 724 to contact a pair of like electrodes (i.e., either a pair of P-electrodes 726' or a pair of N-electrodes 728'). The metallic coupling layer 742' includes a plurality of parallel fingers 744', each having a first end connected to a continuous strip 746', and a second end terminating in a transverse edge portion 749 that overlies a corresponding one of the transverse contact heads 733. The fingers 744' are separated by slots or gaps 748'. The fingers 744' and the slots 748' form an evanescent coupling edge, with the fingers 744' defining the convexities, and the slots 748' defining the concavities, as discussed above with the previously-described embodiments. The fingers 744' and the slots 748' define a coupling edge with a period of 0.8 mm (measured between centers of the edge portions 749).

In this second specific example, the first insulation layer 730 is 0.3 micron thick; the contacts 732' are 1.0 micron thick; and the air gap 752 is 2 mm across. All other dimensions and materials of the various layers in the coupling structure 720 are the same as in the first example described above.

In the second specific example, activating every fifth electrode pair will result in a beam propagating in a direction forming an angle of 73 degrees with respect to the transmission line, while activating every fourth electrode pair will produce a beam propagating at an angle of 90 degrees with respect the transmission line.

What is claimed is:

1. An evanescent coupling antenna, comprising:

a transmission line through which an electromagnetic signal is transmitted;

a metal antenna plate having an evanescent coupling edge with a selectably variable electromagnetic coupling geometry located adjacent the transmission line so as to permit evanescent coupling between the transmission line and the antenna plate.

2. The evanescent coupling antenna of claim 1, wherein the selectably variable coupling geometry comprises:

a pattern of geometric shapes along the coupling edge, the pattern comprising alternating convexities and concavities; and a plurality of switches that are selectably operable to connect electrically adjacent pairs of the convexities.

3. The evanescent coupling antenna of claim 2, wherein the switches are selectably operable in accordance with a computer program.

4. The evanescent coupling antenna of claim 1, wherein the transmission line is selected from the group consisting of at least one of a dielectric waveguide, a slot line, a coplanar line, a rib waveguide, a groove waveguide, and an imaging waveguide.

5. The evanescent coupling antenna of claim 2, wherein the switches are selected from the group consisting of at least one of PIN diodes, bipolar transistors, MOSFETs, HBTs, MEMS, piezoelectric switches, photoconductive switches, capacitive switches, lumped IC switches, ferroelectric switches, electromagnetic switches, gas plasma switches, and semiconductor plasma switches.

6. The evanescent coupling antenna of claim 2, wherein the pattern of alternating convexities and concavities forms an approximately square waveform.

7. The evanescent coupling antenna of claim 6, wherein the concavities and convexities have approximately equal widths.

8. The evanescent coupling antenna of claim 6, wherein the concavities are of a first width and the convexities are of a second width that is not equal to the first width.

9. The evanescent coupling antenna of claim 6, wherein the sum of the width of any one concavity and the width of the next adjacent convexity equals the sum of the width of any other concavity and the width its next adjacent convexity.

10. The evanescent coupling antenna of claim 6, wherein the concavities have a first width and the convexities have a second width, wherein at least one of the first and second widths is not greater than one-half the wavelength of the electromagnetic signal.

11. The evanescent coupling antenna of claim 1, wherein the antenna plate is attached to a substrate selected from the group consisting of at least one of a dielectric material and a semiconductor material.

12. The evanescent coupling antenna of claim 11, wherein the substrate is a dielectric material selected from the group consisting of at least one of quartz, sapphire, ceramic, plastic, and a polymeric composite.

13. The evanescent coupling antenna of claim 11, wherein the substrate is a semiconductor material selected from the group consisting of at least one of silicon, gallium arsenide, gallium phosphide, germanium, gallium nitride, indium phosphide, gallium aluminum arsenide, and SOI.

14. The evanescent coupling antenna of claim 11, further comprising a cover layer covering the antenna plate, whereby the antenna plate is sandwiched between the cover layer and the substrate, and wherein the cover layer is made of a material selected from the group consisting of at least one of quartz, sapphire, ceramic, plastic, a polymeric composite, silicon, gallium arsenide, gallium phosphide, germanium, gallium nitride, indium phosphide, gallium aluminum arsenide, and SOI.

15. The evanescent coupling antenna of claim 11, wherein the substrate has first and second opposed surfaces, the antenna plate being fixed to the first surface, the antenna further comprising a metal backing plate fixed to the second surface and a metal face plate spaced from the antenna plate by a non-metallic layer.

16. The evanescent coupling antenna of claim 15, wherein the non-metallic layer is air.

17. The evanescent coupling antenna of claim 15, wherein the non-metallic layer is made of a material selected from the group consisting of at least one of a semiconductor material and a dielectric material.

18. The evanescent coupling antenna of claim 1, wherein the metal antenna plate is a first metal antenna plate, and wherein the antenna further comprises at least a second metal antenna plate substantially parallel to the first antenna plate and having an evanescent coupling edge with a selectably variable electromagnetic coupling geometry, both the first and second antenna plates being located adjacent to the transmission line so as to permit evanescent coupling between the transmission line and the first and second antenna plates.

19. The evanescent coupling antenna of claim 18, wherein the selectably variable coupling geometry of the coupling edges of the first and second antenna plates permits the variation of the beam direction in two dimensions.

20. An evanescent coupling antenna, comprising:

a transmission line through which an electromagnetic signal is transmitted; and a multilayer coupling structure spaced from and aligned with the transmission line, the coupling structure comprising:

a metal base layer;

a semiconductor layer disposed on the base layer, the semiconductor layer having an upper surface that is doped to provide a pattern of switch electrodes thereon;

a first insulation layer formed on top of the semiconductor layer so as to leave exposed the switch electrodes;

an array of conductive contacts provided on the first insulation layer, each of the contacts having a first end portion extending through the first insulation layer to contact one of the exposed switch electrodes;

a second insulation layer formed on top of the first insulation layer so as to cover the array of contacts except for an exposed second end portion of each of the contacts; and a metal antenna layer formed on top of the second insulation layer, the antenna layer defining an evanescent coupling edge having alternating concavities and convexities, each of the convexities overlying an adjacent pair of contacts;

whereby selected electrode pairs may be energized through the contacts to form a conductive link between each energized electrode pair that is capacitively coupled to corresponding ones of the convexities.

21. The evanescent coupling antenna of claim 20, further comprising a metal cover plate spaced from the coupling structure by an air gap.

22. The evanescent coupling antenna of claim 20, wherein the coupling layer comprises a plurality of fingers, each of which defines one of the convexities of the coupling edge.

23. The evanescent coupling antenna of claim 20, wherein the coupling edge defines a periodic structure.

24. The evanescent coupling antenna of claim 23, wherein the periodic structure has a period of about 0.7 mm to about 0.8 mm.

25. An evanescent coupling antenna, comprising:

a stacked array of planar antenna elements defining substantially parallel planes, each of the antenna elements having an evanescent coupling edge with a selectably variable electromagnetic coupling geometry; and a transmission line element located adjacent the stacked array of antenna elements so as to permit evanescent coupling between the transmission line element and the coupling edges of the antenna elements.

26. The evanescent coupling antenna of claim 25, wherein the transmission line element is substantially orthogonal to the planes defined by the antenna elements.

27. The evanescent coupling antenna of claim 25, wherein the transmission line element is substantially parallel to the planes defined by the antenna elements.

28. The evanescent coupling antenna of claim 25, wherein the transmission line element comprises an array of substantially parallel linear transmission lines that are substantially orthogonal to the planes defined by the antenna elements.

29. The evanescent coupling antenna of claim 25, wherein the transmission line element comprises an array of substantially parallel linear transmission lines that are substantially parallel to the planes defined by the antenna elements.

30. The evanescent coupling antenna of claim 25, wherein the transmission line element comprises a planar transmission line that is substantially orthogonal to the planes defined by the antenna elements.

* * * * *